US007707660B2

(12) United States Patent
Grilliot et al.

(10) Patent No.: US 7,707,660 B2
(45) Date of Patent: May 4, 2010

(54) PROTECTIVE GARMENT AND DRAG HARNESS WITH FLAP

(75) Inventors: Mary I. Grilliot, Dayton, OH (US); William L. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/805,977

(22) Filed: May 25, 2007

(65) Prior Publication Data

US 2008/0289086 A1 Nov. 27, 2008

(51) Int. Cl.
*G21F 3/02* (2006.01)

(52) U.S. Cl. ..... 2/455; 2/93; 182/3

(58) Field of Classification Search ..... 2/458, 2/93, 310, 329, 331, 69, 69.5, 81, 94, 79, 2/227, 97, 456, 305; 182/3–7; 244/143, 244/151 R See application file for complete search history.

(56) References Cited

U.S. PATENT DOCUMENTS 2,979,153 A * 4/1961 Hoagland et al. ..... 182/3
3,074,074 A * 1/1963 Lovering ..... 2/94
3,973,643 A * 8/1976 Hutchinson ..... 182/3
3,997,921 A * 12/1976 Knight ..... 2/75
4,449,253 A * 5/1984 Hettinger ..... 2/93
4,625,334 A * 12/1986 Proffer ..... 2/1
4,854,418 A * 8/1989 Hengstenberger et al. ..... 182/3
5,542,123 A * 8/1996 DiPietro ..... 2/80
6,205,584 B1 * 3/2001 Yocco ..... 2/69
6,487,725 B1 * 12/2002 Jordan ..... 2/94
6,658,666 B2 * 12/2003 Schweer ..... 2/94
7,356,850 B2 * 4/2008 Turcotte et al. ..... 2/69
2004/0004367 A1 * 1/2004 Main et al. ..... 294/150
2005/0173188 A1 * 8/2005 Lewis et al. ..... 182/3
2007/0044197 A1 * 3/2007 Turcotte et al. ..... 2/69
2007/0192926 A1 * 8/2007 Fee et al. ..... 2/81

* cited by examiner

*Primary Examiner*—Katherine Moran
*Assistant Examiner*—Richale L Quinn
(74) *Attorney, Agent, or Firm*—Wood, Philiips, Katz, Clark & Mortimer

(57) ABSTRACT

A protective garment for a fire fighter or emergency worker is provided. The protective garment includes an outer shell and a drag harness located at least substantially within the outer shell. The drag harness includes a wearer portion, a gripping portion and a flap operably coupled to the gripping portion. The flap is releasably secured to the outer shell in a stored state. The flap and the gripping portion remaining operably coupled to one another and extend away from the outer shell in a deployed state to drag a wearer.

15 Claims, 2 Drawing Sheets

PROTECTIVE GARMENT AND DRAG HARNESS WITH FLAP

FIELD OF THE INVENTION

This invention pertains to a protective garment such as for a firefighter or emergency worker, and in more particular applications, to a protective garment having including a drag harness.

BACKGROUND OF THE INVENTION

Commonly, a firefighter or an emergency worker wears a protective garment, such as a protective coat. Furthermore, firefighters or emergency workers also wear additional safety equipment, such as drag harnesses, such that the wearer can be dragged and/or carried by a rescuer should the wearer become incapacitated. These drag harnesses can be worn within or on the exterior of the of the protective garment.

Protective garments and drag harnesses have generally been configured to have a pull strap located behind the head of the wearer. In this form, the pull strap can be extended from the protective garment to drag the wearer should the wearer become injured or incapacitated. However, the drag harness is susceptible to catching on or becoming abraded by external surfaces. Therefore, drag harnesses may be located completely within the protective garment and/or covered by pockets or flaps. However, the drag harness must still be capable of being grasped quickly in an emergency situation. Furthermore, the rescuer is generally wearing bulky gloves which provide diminished tactile feedback.

SUMMARY OF THE INVENTION

In one form, a protective garment for a firefighter or emergency worker is provided. The protective garment includes an outer shell and a drag harness. The drag harness is located at least substantially within the outer shell and includes a wearer portion, a gripping portion and a flap operably coupled to the gripping portion. The flap is releasably secured to the outer shell in a stored state. The flap and gripping portion remain operably coupled to one another and extend away from the outer shell in an deployed state to drag a wearer.

According to one form, a protective garment for a firefighter or emergency worker is provided. The protective garment includes an outer shell and a drag harness. The outer shell has at least one aperture. The drag harness is located at least substantially within the outer shell. The drag harness includes a wearer portion, a gripping portion and a flap operably coupled to the gripping portion. The flap releasably is secured to and substantially covers the at least one aperture in a stored state. The flap is graspable by a rescuer to pull the flap away from the outer shell and the gripping portion through the aperture in a deployed state to drag a wearer.

In one form, wherein the outer shell includes two apertures.

According to one form, at least a part of the gripping portion is permanently affixed to the flap.

In one form, the flap comprises an outer surface and an interior space such that a part of the gripping portion passes through the interior space and the flap is movable along the gripping portion.

According to one form, the flap is a gripping handle whereby a rescuer may drag the wearer.

In one form, the protective garment further includes at least one releasable fastener selected from the group comprising hook and loop fasteners, snap fasteners and button fasteners to releasably secure the flap to the outer shell in the stored state.

According to one form, the outer shell is made from a fire resistant material and the flap is made from the same fire resistant material.

In one form, substantially all of the outer shell has an outer appearance of a first visible color and the flap has an outer appearance of a second visible color which contrasts the first color.

Other objects, features, and advantages of the invention will become apparent from a review of the entire specification, including the appended claims and drawings.

DETAILED DESCRIPTION OF THE ILLUSTRATED EMBODIMENT

Figure 1:
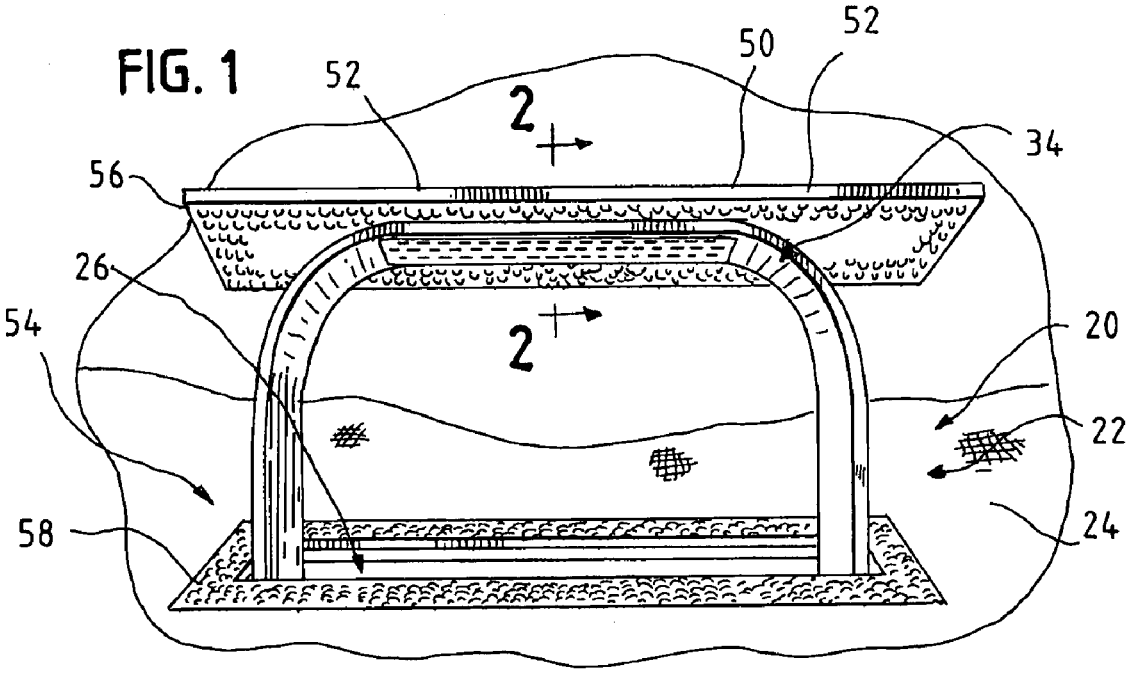
FIG. 1 is a perspective view of a protective garment including a drag harness and a flap.
Figure 2:
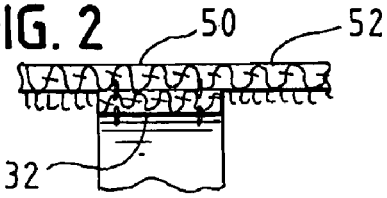
FIG. 2 is a cross-sectional view taken along line 2-2 of the drag harness and flap of FIG. 1.

As illustrated in FIG. 1, a protective garment 20 is shown. The protective garment may take a variety of forms such as a protective coat 22 or protective pants (not shown). The protective garment 20 may be similar to many conventional types of protective garments known to those skilled in the art and therefore those common features will not be discussed in detail herein. For example, the protective garment may include a protective outer shell and one or more thermal and/or water resistant liners. As described herein the protective garment 20 includes additional features which will be detailed below. Furthermore, it should be understood that these additional features may be added to many forms of existing protective garments such that the garment may be retro-fit to accommodate the additional features.

Figure 3:
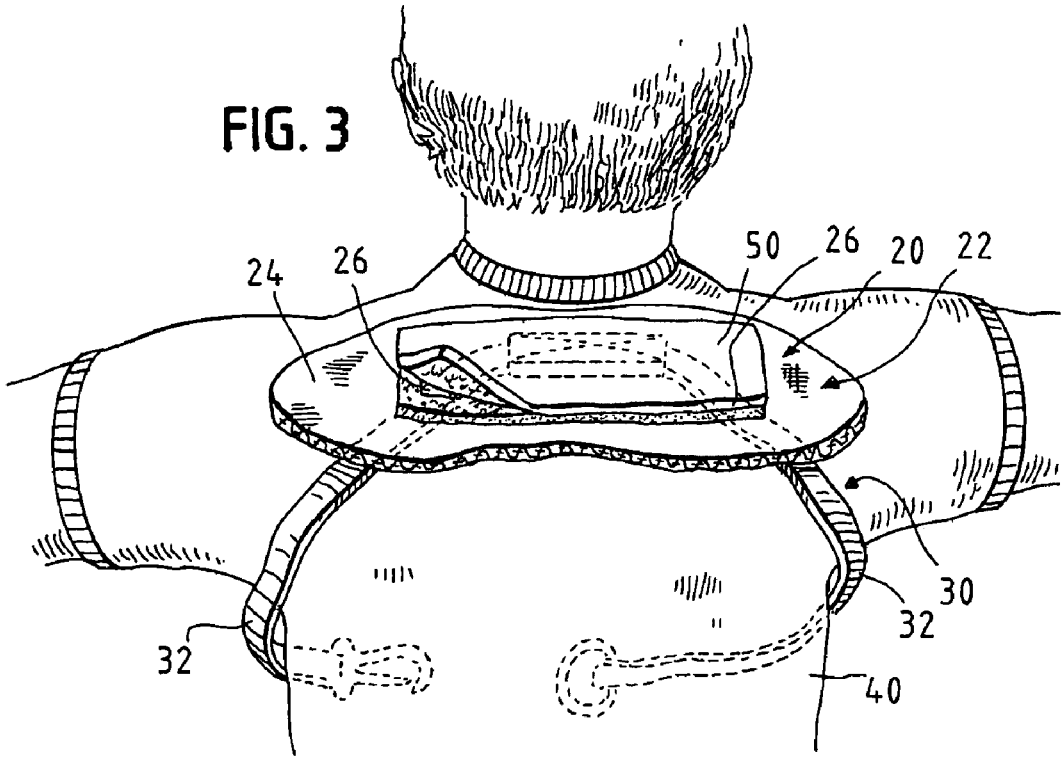
FIG. 3 is a fragmentary perspective view of a protective garment, drag harness and flap as worn by a wearer.
Figure 4:
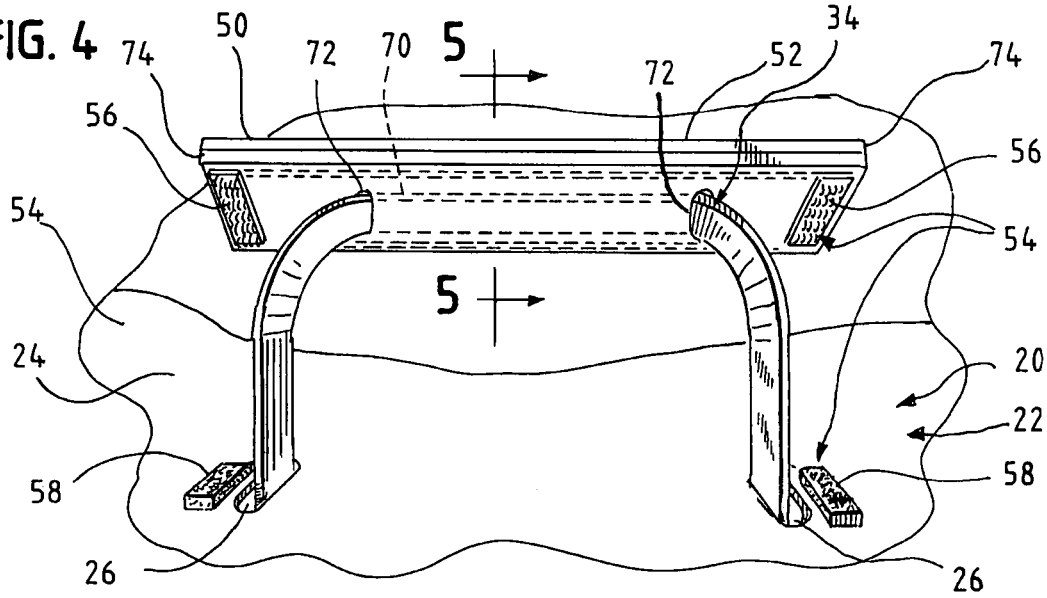
FIG. 4 is a perspective view of a protective garment including a drag harness and a flap.
Figure 5:
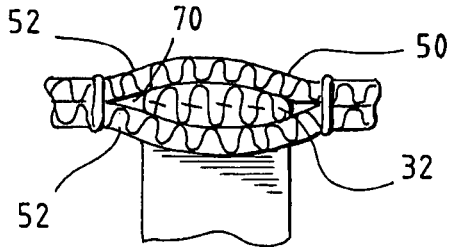
FIG. 5 is a cross-sectional view taken along line 5-5 of the drag harness and flap of FIG. 4.

The protective garment 20 includes an outer shell 24 having at least one aperture 26. However, it should be understood that the garment 20 may include multiple apertures 26, such as seen in FIGS. 3 and 4. The aperture(s) 26 can be used to provide an opening to gain access to various components or objects located within the outer shell 24.

For example, a drag harness 30 may be located at least substantially within the outer shell 24. Referring to FIGS. 1 and 3, in one form the drag harness 30 includes a wearer portion 32 and a gripping portion 34. The wearer portion 32 extends at least partially around a portion of the wearer. For example, in the form shown in FIG. 3, the wearer portion 32 extends at least partially around the torso 40 of the wearer. In other forms, the wearer portion may extend at least partially around a limb of the wearer, such as an arm or leg. Furthermore, the drag harness 30 may include multiple wearer portions 32. The gripping portion 34 may be a separate component affixed to the wearer portion 32, or may be an integrated as part of the wearer portion 32 to form a single loop, as shown in FIG. 3.

Generally, the gripping portion 34 can be used by a rescuer to grip the drag harness 30 to drag the wearer. In this manner, when the gripping portion 34 is pulled by the rescuer, the wearer portion 32 will tighten against at least a portion of the wearer so that the wearer can be dragged and/or carried.

Figure 6:
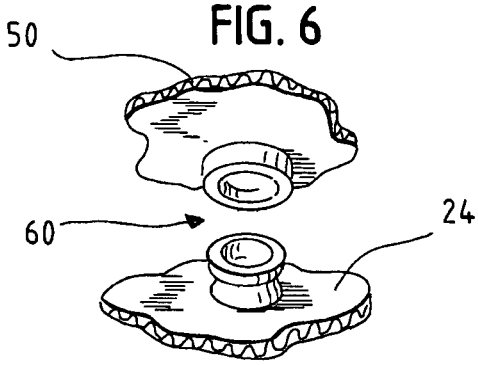
FIG. 6 is a fragmentary view of one form of a releasable fastener.
Figure 7:
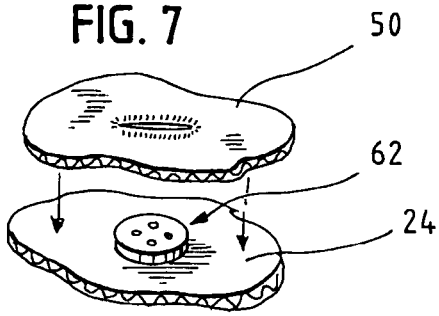
FIG. 7 is a fragmentary view of another form of a releasable fastener.

As shown in FIG. 1, one form of a flap 50 is shown. In this form, the flap 50 includes an outer surface 52 and at least one releasable fastener 54. As seen in FIG. 1, the releasable fastener 54 includes hook 56 and loop 58 portions to releasably secure the flap to the protective garment 20. However, it should be understood that other types of fasteners may be used such as a snap 60 as found in FIG. 6, a button 62 as found in FIG. 7 and other forms of releasable fasteners as understood by those skilled in the art.

Furthermore, referring again to FIG. 1, the releasable fastener 54 is shown surrounding the aperture 26. It should be understood that this form may be used with multiple apertures 26, such as shown in FIG. 3. In another form, as shown in FIG. 4, the releasable fastener 54 does not surround the apertures 26, but instead is located adjacent a portion of the apertures 26. It should be understood that this form may also be used with a single aperture 26. Furthermore, it should be understood that the releasable fastener 54 may be located adjacent other portions of the aperture 26 and/or may be located remotely from the apertures 26.

In one preferred form, the flap 50 is sized such that it substantially covers the one or more apertures 26. In this regard, the flap 50 can prevent moisture and debris from entering the aperture 26. Furthermore, the size and orientation of the flap 50 can prevent the drag harness 30 from being snagged and/or abraded on external surfaces.

The flap 50 may be operably coupled to the drag harness 30 in a variety of manners. For example, referring to FIG. 1, the flap 50 is operably coupled to the gripping portion 34 of the drag harness 30 such as by sewing the flap 50 to the gripping portion 34. In this form, the flap 50 can help prevent the drag harness 30 from shifting significantly as it is worn by a wearer. In the embodiment of FIG. 1, the gripping portion 34 is a continuous length of material. It should be understood that this form may also be implemented wherein the gripping portion 34 includes two ends which are each sewn to the flap 50. Furthermore, it should be understood that other methods may be utilized to connect the flap 50 to the gripping portion 34, such as rivets, adhesive and other forms understood by those skilled in the art.

Referring to FIG. 4, the flap 50 is operably coupled to the gripping portion 34 in another manner. In this form, the flap 50 includes an interior space 70 whereby the gripping portion 34 is permitted to pass through. As shown in FIG. 4, the interior space 70 is accessible via apertures 72 in the outer surface 52. However, it should be understood that the apertures 72 may also be located at other locations on the flap 50, such as at ends 74. As the gripping portion 34 extends through the interior space 70 and is not secured thereto, the flap 50 is permitted to move along the length of the gripping portion 34, such as when a rescuer is dragging the wearer. However, it should be understood that the gripping portion 34 may be secured to the flap if desired.

It should be understood by those skilled in the art that the forms illustrated in the figures may be intermixed to produce a desired combination of elements. For example, the number of apertures 26, the number and orientation of the releasable fasteners 54, the method of coupling the flap 50 to the gripping portion 34, as well as the type of flap 50 may be intermixed to produce a desired combination of elements.

It should also be understood that the drag harness 30 may also be utilized in other protective garments, such as protective pants. In this form, the protective garment would include the outer shell 24 and the drag harness 30 would still include the wearer portion 32, the gripping portion 34 and the flap 50. Again, any combination of elements may be chosen to produce a desired combination of elements.

It should be understood that the drag harness 30 may be sewn into a layer of the protective garment 20. In another form, the drag harness 30 may also be releasably secured within the protective garment 20 by a variety of fastening means known by those skilled in the art, such as snaps, hook and loop fasteners and the like. The protective garment 20, drag harness 30 and flap 50 may be made from a variety of materials. Furthermore the protective garment 20, drag harness 30 and flap 50 may be made of the same or different materials. In one form, the drag harness 30 and the flap 50 are made of fire resistant material, such as Nomex® or Kevlar®. However, it should be understood that a variety of other materials may be used. Furthermore, the drag harness 30 may be made of a rope-type material, a web-type material and other forms understood by those skilled in the art. The drag harness 30 may be made of different materials based upon the location of the drag harness 30 on the wearer's body. For example, the gripping portion 34 may be made of different materials than the wearer portion 32.

The flap 50 can be used as a gripping handle for grasping the gripping portion 34 of the drag harness 30. In this regard, the flap 50 can include reinforcing structure to make the flap more rigid and potentially easier to grasp. Furthermore, the flap 50 can be made from a material having a specific color. For example, the outer shell 24 may be a dark color while the flap 50 can be a lighter color and/or made from a reflective material to increase the visibility of the flap 50.

The flap 50 and the gripping portion 34 can be used by a rescuer to drag and/or carry the wearer. The flap 50 is releasably secured to the outer shell 24 in a stored state, but may be removed to extend away from the outer shell 24 in a deployed state to drag the wearer. A rescuer can pull on the flap 50, which is completely separable from the outer shell 24 and can grasp the flap 50 and/or gripping portion 34.

It should be appreciated that for all of the disclosed embodiments there are many possible modifications. Additionally, it should be understood that the embodiments described herein may be utilized in conjunction with one another or separately.

The invention claimed is:

1. A protective garment for a firefighter or emergency worker, the protective garment comprising:

an outer shell; and a drag harness located at least substantially within the outer shell, the drag harness including a wearer portion, a gripping portion and a flap located outside of the outer shell and operably coupled to the gripping portion, the flap being releasably secured to the outer shell in a stored state and completely detached from the outer shell in a deployed state with the flap and gripping portion remaining operably coupled to one another and extending outside and away from the outer shell in the deployed state to drag a wearer.

2. The protective garment of claim 1 wherein at least a part of the gripping portion is permanently affixed to the flap.

3. The protective garment of claim 1 wherein the flap comprises an outer surface and an interior space such that a part of the gripping portion passes through the interior space and the flap is movable along the gripping portion.

4. The protective garment of claim 1 wherein the flap is a gripping handle whereby a rescuer may drag the wearer.

5. The protective garment of claim 1 further comprising at least one releasable fastener selected from the group comprising hook and loop fasteners, snap fasteners and button fasteners to releasably secure the flap to the outer shell in the stored state.

6. The protective garment of claim 1 wherein the outer shell is made from a fire resistant material and the flap is made from the same fire resistant material.

7. The protective garment of claim 1 wherein substantially all of the outer shell has an outer appearance of a first visible color and the flap has an outer appearance of a second visible color which contrasts the first color.

8. A protective garment for a firefighter or emergency worker, the protective garment comprising:

an outer shell having at least one aperture; and a drag harness located at least substantially within the outer shell, the drag harness including a wearer portion, a gripping portion and a flap attached to the gripping portion and releasably secured to and substantially covering the at least one aperture in a stored state to be graspable by a rescuer to pull the flap and the gripping portion away from the outer shell with the flap completely detached from the outer shell and the gripping portion extending through the aperture in a deployed state to drag a wearer.

9. The protective garment of claim 8 wherein the outer shell comprises two apertures.

10. The protective garment of claim 8 wherein at least a part of the gripping portion is permanently affixed to the flap.

11. The protective garment of claim 8 wherein the flap comprises an outer surface and an interior space such that a part of the gripping portion passes through the interior space and the flap is movable along the gripping portion.

12. The protective garment of claim 8 wherein the flap is a gripping handle whereby a rescuer may drag the wearer.

13. The protective garment of claim 8 further comprising at least one releasable fastener selected from the group comprising hook and loop fasteners, snap fasteners and button fasteners to releasably secure the flap to the outer shell in the stored state.

14. The protective garment of claim 8 wherein the outer shell is made from a fire resistant material and the flap is made from the same fire resistant material.

15. The protective garment of claim 8 wherein substantially all of the outer shell has an outer appearance of a first visible color and the flap has an outer appearance of a second visible color which contrasts the first color.

* * * * *